US011712867B2

(12) United States Patent
Mizutani et al.

(10) Patent No.: US 11,712,867 B2
(45) Date of Patent: Aug. 1, 2023

(54) SINGLE FACER, METHOD FOR SWITCHING CORRUGATED ROLL UNIT, AND METHOD FOR EXCHANGING CORRUGATED ROLL UNIT

(71) Applicant: MITSUBISHI HEAVY INDUSTRIES MACHINERY SYSTEMS, LTD., Hyogo (JP)

(72) Inventors: Hideki Mizutani, Hyogo (JP); Takashi Nitta, Hyogo (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 373 days.

(21) Appl. No.: 17/042,994

(22) PCT Filed: Feb. 13, 2019

(86) PCT No.: PCT/JP2019/005101
§ 371 (c)(1),
(2) Date: Sep. 29, 2020

(87) PCT Pub. No.: WO2019/187726
PCT Pub. Date: Oct. 3, 2019

(65) Prior Publication Data

US 2021/0008826 A1 Jan. 14, 2021

(30) Foreign Application Priority Data

Mar. 30, 2018 (JP) ..... 2018-068151

(51) Int. Cl.
*B31F 1/28* (2006.01)

(52) U.S. Cl.
CPC ..... *B31F 1/2868* (2013.01); *B31F 1/2831* (2013.01)

(58) Field of Classification Search
CPC .. B31F 1/2868; B31F 1/20; B31F 1/26; B31F 1/2836; B31F 1/2863
See application file for complete search history.

(56) References Cited

U.S. PATENT DOCUMENTS 3,638,468 A * 2/1972 Fukui ..... B21B 31/103 72/239
3,747,387 A * 7/1973 Shumaker ..... B21B 31/10 72/239

(Continued)

FOREIGN PATENT DOCUMENTS

JP S63115731 A 5/1988
JP H11198256 A 7/1999

(Continued)

OTHER PUBLICATIONS

Office Action for Japanese Application No. 2018-068151 dated Dec. 14, 2021; 8pp.

*Primary Examiner* — Chelsea E Stinson
(74) *Attorney, Agent, or Firm* — Kanesaka Berner and Partners LLP

(57) ABSTRACT

A single facer equipped with a plurality of corrugated roll units each composed of a pair of corrugated rolls is provided with: a lifting/lowering device that causes each of the corrugated roll units to be lifted and lowered between a use position at which a core sheet is to be corrugated, a first position adjacent to and directly under the use position, and a second position adjacent to and directly under the first position; a horizontal movement device that causes each of the corrugated roll units to be moved horizontally between the first position, a third position adjacent to the first position on one side in a sheet transfer direction, and a fourth position adjacent to the first position on the other side in the sheet transfer direction; and a control device that controls the (Continued)

lifting/lowering device and the horizontal movement device to move the corrugated roll units.

10 Claims, 4 Drawing Sheets

(56) References Cited

U.S. PATENT DOCUMENTS

| | | | | |
|---|---|---|---|---|
| 5,150,514 | A * | 9/1992 | Seki | B31F 1/2868 72/239 |
| 7,617,856 | B2 | 11/2009 | Gnan | |
| 8,512,025 | B1 * | 8/2013 | Chen | B31F 1/26 425/186 |
| 9,193,127 | B2 * | 11/2015 | Yamada | B31F 1/2868 |
| 10,059,073 | B2 * | 8/2018 | Yamada | B31F 1/2895 |
| 2015/0030713 | A1 * | 1/2015 | Yamada | B31F 1/2868 425/336 |
| 2017/0173914 | A1 * | 6/2017 | Yamada | B31F 1/2895 |

FOREIGN PATENT DOCUMENTS

| | | | |
|---|---|---|---|
| JP | 2003104615 | A | 4/2003 |
| JP | 2015024577 | A | 2/2015 |
| JP | 6120714 | B2 | 4/2017 |
| JP | 2017109437 | A | 6/2017 |

* cited by examiner

SINGLE FACER, METHOD FOR SWITCHING CORRUGATED ROLL UNIT, AND METHOD FOR EXCHANGING CORRUGATED ROLL UNIT

RELATED APPLICATIONS

The present application is a National Phase of International Application Number PCT/JP2019/005101 filed Feb. 13, 2019 and claims priority to Japanese Application Number 2018-068151 filed Mar. 30, 2018.

TECHNICAL FIELD

The present invention relates to a single facer, a method for switching a corrugated roll unit of a single facer, and a method for exchanging a corrugated roll unit of a single facer.

BACKGROUND ART

It is necessary to exchange a corrugated roll unit composed of an upper corrugating roll and a lower corrugating roll in order to manufacture different types of flute-shaped single-faced cardboards with one single facer.

In recent years, a single facer has been developed in which two corrugated roll units are provided in the machine and the corrugated roll unit that is used can be switched as necessary in response to a request for simple switching operation-based corrugated roll unit exchange.

PTL 1 discloses a single facer including an up-down direction movement device including two sets of cartridges (corrugated roll units) and lifting and lowering the cartridges for alternate positioning at corrugated roll use and rest positions and a horizontal direction movement device moving the cartridge in a horizontal direction parallel to a sheet transfer direction and temporarily retracting the cartridge to a retracted position in the machine in order to switch the up-down disposition position of the cartridge.

As a result, the two cartridges can be switched and used as necessary, the single facer is capable of manufacturing two types of single-faced cardboards with high operation efficiency, and productivity can be enhanced.

CITATION LIST

Patent Literature

[PTL 1] Japanese Unexamined Patent Application Publication No. 2017-109437

SUMMARY OF INVENTION

Technical Problem

Although the single facer disclosed in PTL 1 described above is capable of efficiently manufacturing two types of single-faced cardboards, it has been desired to efficiently manufacture more types of single-faced cardboards with one single facer.

The present invention has been made in view of such problems, and an object of the present invention is to provide a single facer, a method for switching a corrugated roll unit of a single facer, and a method for exchanging a corrugated roll unit of a single facer allowing more than two corrugated roll units to be provided in the device and the corrugated roll units to be switched and used by simple operation.

Solution to Problem (1) In order to achieve the above object, a single facer of the present invention equipped with a plurality of corrugated roll units each composed of a pair of corrugated rolls includes a lifting/lowering device causing each of the corrugated roll units to be lifted and lowered between a use position at which a medium is to be corrugated, a first position adjacent to and directly under the use position, and a second position adjacent to and directly under the first position, a horizontal movement device causing each of the corrugated roll units to be moved horizontally between the first position, a third position adjacent to the first position on one side in a sheet transfer direction, and a fourth position adjacent to the first position on the other side in the sheet transfer direction, and a control device controlling the lifting/lowering device and the horizontal movement device to move the corrugated roll units.

(2) Preferably, three corrugated roll units having different flutes are provided, and the control device disposes any one of the corrugated roll units suitable for a production order at the use position and disposes the remaining two corrugated roll units at standby positions which are any two of the first to fourth positions.

(3) Preferably, the first position and the second position are exchange positions used when the corrugated roll units are exchanged and the third position and the fourth position are the standby positions, and the control device uses the first position and the second position in performing exchange between the corrugated roll unit disposed at the use position and the corrugated roll unit disposed at the third position or the fourth position in accordance with a change in production order.

(4) Preferably, the lifting/lowering device includes two stages of accommodation support spaces accommodating and supporting the corrugated roll units to be lifted and lowered, one above the other, and is configured to be lifted and lowered in a state where the corrugated roll units are accommodated and supported in the respective accommodation support spaces.

(5) Preferably, when exchange is performed between the corrugated roll unit disposed at the use position and the corrugated roll unit disposed at the third position in accordance with a change in production order, the control device horizontally moves the corrugated roll unit disposed at the fourth position to the first position by operating the horizontal movement device, lowers the corrugated roll unit at the use position to the first position and lowers the corrugated roll unit at the first position to the second position by operating the lifting/lowering device, horizontally moves the corrugated roll unit at the third position to the first position and horizontally moves the corrugated roll unit at the first position to the fourth position by operating the horizontal movement device, lifts the corrugated roll unit at the first position to the use position and lifts the corrugated roll unit at the second position to the first position by operating the lifting/lowering device, and horizontally moves the corrugated roll unit at the first position to the third position by operating the horizontal movement device.

(6) Preferably, the single facer further includes a support mechanism having a movable support member capable of switching between a retracted position not interfering with the corrugated roll unit when the corrugated roll unit is lifted and lowered to the use position and a support position supporting the corrugated roll unit at the use position, and the control device performs control to switch a position of the movable support member between the retracted position and the support position.

(7) Preferably, the single facer further includes a width direction movable mechanism allowing the corrugated roll unit at at least one of the two standby positions to move in a device width direction orthogonal to the sheet transfer direction.

(8) Preferably, the single facer further includes a width direction movement device moving the corrugated roll unit at the one standby position in the device width direction.

(9) A method for switching a corrugated roll unit of a single facer of the present invention is for switching the corrugated roll unit to be used by performing exchange between the corrugated roll unit disposed at the use position and the corrugated roll unit disposed at the third position in accordance with a change in production order in the single facer including the configuration of (3) described above, and the method includes a step of horizontally moving the corrugated roll unit disposed at the fourth position to the first position by operating the horizontal movement device, a step of lowering the corrugated roll unit at the use position to the first position and lowering the corrugated roll unit at the first position to the second position by operating the lifting/lowering device, a step of horizontally moving the corrugated roll unit at the third position to the first position and horizontally moving the corrugated roll unit at the first position to the fourth position by operating the horizontal movement device, a step of lifting the corrugated roll unit at the first position to the use position and lifting the corrugated roll unit at the second position to the first position by operating the lifting/lowering device, and a step of horizontally moving the corrugated roll unit at the first position to the third position by operating the horizontal movement device.

(10) A method for exchanging a corrugated roll unit of a single facer of the present invention is for exchanging the corrugated roll unit at the standby position in the single facer including the configuration of (7) described above, and the method includes a carrying-out step of moving the corrugated roll unit at the one standby position in a carrying-out direction of the device width direction and carrying out the corrugated roll unit and a carrying-in step of moving a corrugated roll unit different from the carried-out corrugated roll unit in a carrying-in direction of the device width direction and carrying in the different corrugated roll unit.

Advantageous Effects of Invention

According to the single facer of the present invention, the first position adjacent to and directly under the use position at which the medium is to be corrugated and the second position adjacent to and directly under the first position are provided and the third position adjacent to the first position on one side in the sheet transfer direction and the fourth position adjacent to the first position on the other side in the sheet transfer direction are provided, and thus switching between the corrugated roll unit at the use position and any one of the corrugated roll units standing by at the two non-use positions by means of the lifting/lowering device and the horizontal movement device and use are possible when the corrugated roll units respectively stand by at the two out of the four positions of the first position to the fourth position other than the use position. Accordingly, it becomes possible to provide a total of three corrugated roll units in the device of the single facer and switch and use the corrugated roll units by simple operation.

BRIEF DESCRIPTION OF DRAWINGS

FIG. 2A illustrates a pre-switching state where a corrugated roll unit is at a use position, and FIG. 2B illustrates a state where the corrugated roll unit is in the process of switching.

DESCRIPTION OF EMBODIMENTS

Hereinafter, an embodiment of the present invention will be described with reference to the drawings.

It should be noted that each embodiment described below is merely an example and there is no intention to exclude the application of various modifications and techniques not specified in the following embodiment. Each configuration of the following embodiment can be variously modified and implemented without departing from the spirit thereof and can be selected or appropriately combined as necessary.

[Single Facer]

First, the configuration of the principal section of a single facer according to the present embodiment will be described with reference to FIG. 1.

Figure 1:
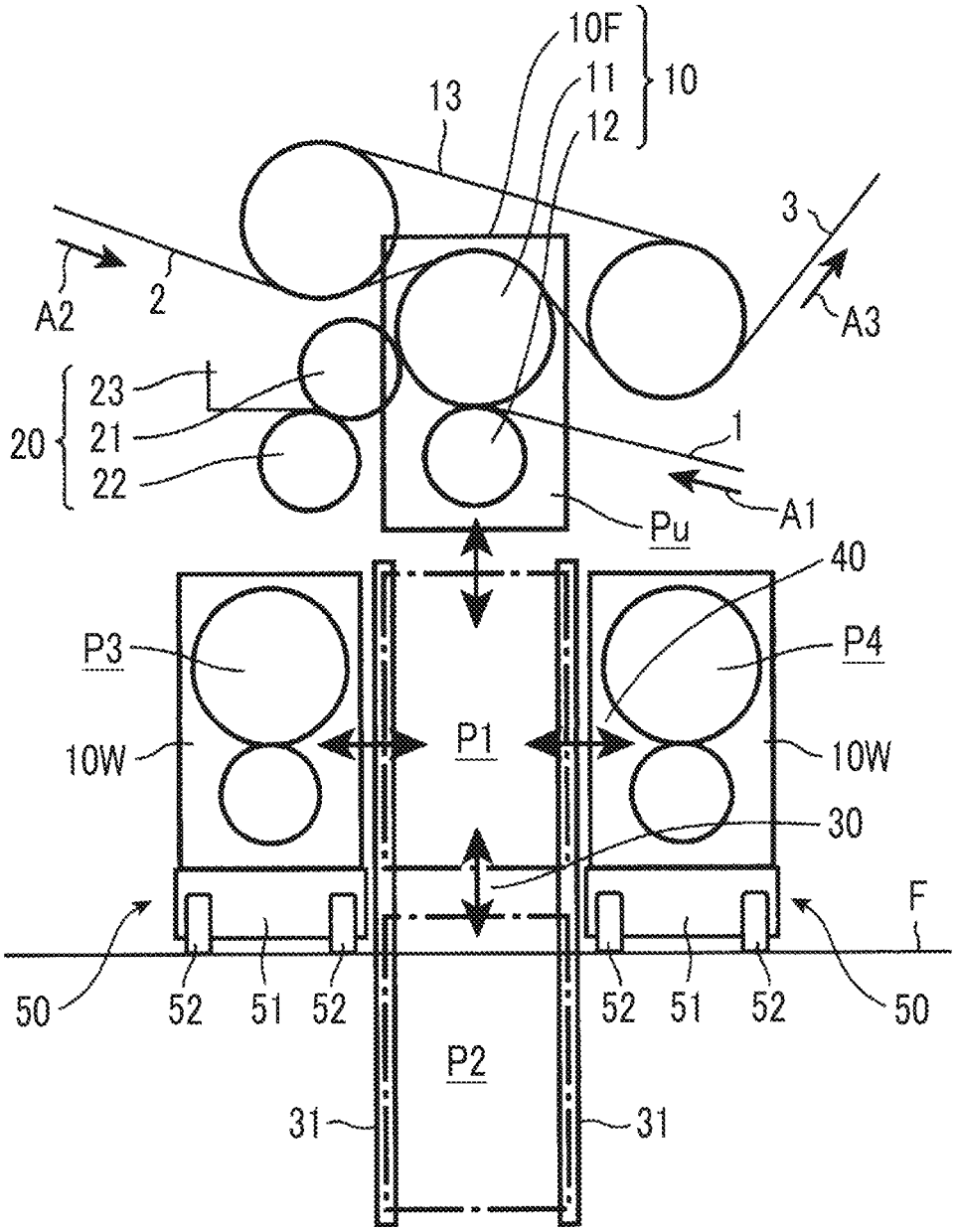
FIG. 1 is a side view of the principal section of a single facer according to one embodiment of the present invention.

As illustrated in FIG. 1, the single facer of the present embodiment includes a corrugated roll unit 10 composed of a pair of corrugated rolls meshing with each other and rotating in a facing manner, that is, an upper corrugating roll 11 and a lower corrugating roll 12. A medium 1 and a liner 2 are processed while being transferred in the directions indicated by arrows A1 and A2 in FIG. 1. The transfer direction will be referred to as a sheet transfer direction in the following description.

In the present single facer, the medium 1 is corrugated into a wave shape by passing through the gap between the upper corrugating roll 11 and the lower corrugating roll 12. The present single facer manufactures a single-faced cardboard 3 by joining the liner 2 fed through another passage to the medium 1 and applying a predetermined temperature and a predetermined pressurizing force thereto after applying glue by means of adhesive equipment 20 to the mountain-shaped corrugated top formed by the corrugation while moving the medium 1 corrugated as described above together with the peripheral surface of the upper corrugating roll 11. An arrow A3 indicates the transfer direction of the single-faced cardboard 3.

It should be noted that the adhesive equipment 20 includes an adhesive applicator roll 21, a doctor roll 22, and an adhesive pan 23 having one side wall formed by these rolls 21 and 22.

In addition, the single facer of the present embodiment is a belt pressurization-type single facer applying pressurizing force by means of an endless belt 13 to the medium 1 and the liner 2 sandwiched between the upper corrugating roll 11 and the endless belt 13 above the upper corrugating roll 11 and transferred.

[Corrugated Roll Unit]

Figure 2A:
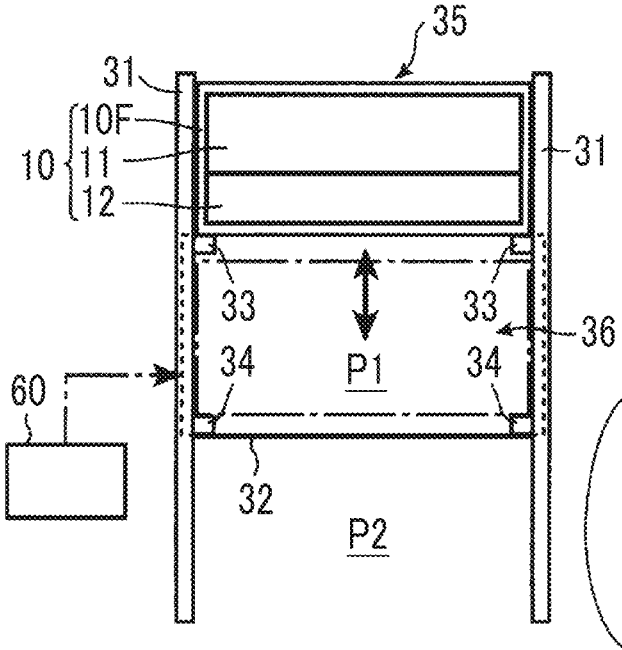
FIGS. 2A and 2B are a front view illustrating a lifting/lowering device of the single facer according to one embodiment of the present invention.
Figure 2B:
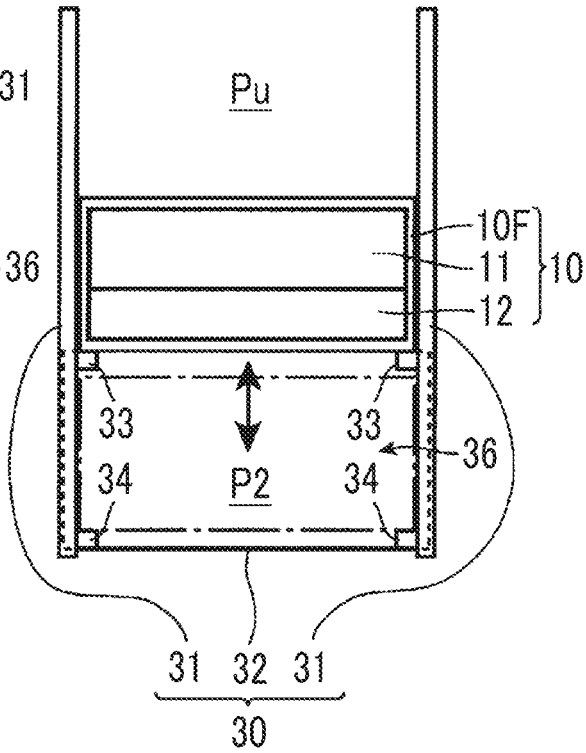

As illustrated in FIGS. 1 and 2 (FIGS. 2A and 2B), the corrugated roll unit 10 includes a frame 10F, the upper corrugating roll 11 and the lower corrugating roll 12 disposed in a predetermined posture in the frame 10F, and bearing portions (not illustrated) respectively supporting the corrugated rolls 11 and 12 in a rotatable and pivotal manner. The corrugated roll unit 10 is configured in a cartridge shape that can be moved and exchanged by a lifting/lowering device 30 (described below) and a horizontal movement device 40 (described below).

[Lifting/Lowering Device, Horizontal Movement Device, and Width Direction Movable Mechanism]

As illustrated in FIGS. 1 and 2 (FIGS. 2A and 2B), in the device of the single facer, the four movable positions of a first position P1 directly under a use position Pu, a second position P2 directly under the first position P1, a third position P3 adjacent to the first position P1 on one side along the sheet transfer direction, and a fourth position P4 adjacent to the first position P1 on the other side along the sheet transfer direction are provided as positions for disposing the corrugated roll unit 10 in addition to the use position Pu at which the medium 1 is to be corrugated. Each of the first position P1, the third position P3, and the fourth position P4 is horizontally arranged on a floor surface F of a factory. It should be noted that the above-described provision of the respective positions Pu and P1 to P4 means that a "space" where the corrugated roll unit 10 can be accommodated is provided at each of the positions Pu and P1 to P4. In FIG. 1, the corrugated roll units 10 are respectively disposed in the spaces of the use position Pu, the third position P3, and the fourth position P4 and the spaces of the first position P1 and the second position P2 (indicated by a one-dot chain line) are empty.

The lifting/lowering device 30 lifts and lowers the corrugated roll unit 10 between the use position Pu, the first position P1, and the second position P2 and includes a column 31, a lifting/lowering body 32 lifted and lowered along the column 31, and a lifting/lowering actuator (not illustrated) driving the lifting/lowering body 32 to be lifted and lowered.

It should be noted that an actuator using a chain and an electric motor or a hydraulic cylinder can be used as the actuator.

The lifting/lowering body 32 has an upper support arm 33 and a lower support arm 34, which support the frame 10F of the corrugated roll unit 10. An accommodation support space 35 accommodating and supporting the corrugated roll unit 10 is provided above the support arm 33, and an accommodation support space 36 accommodating and supporting the corrugated roll unit 10 is provided above the support arm 34. Accordingly, the support arms 33 and 34 and the accommodation support spaces 35 and 36 are provided in two stages, one above the other.

It should be noted that the corrugated roll unit 10 is accommodated in the region indicated by a one-dot chain line in a case where the corrugated roll unit 10 is accommodated in the accommodation support space 36 although the corrugated roll unit 10 is accommodated only in the accommodation support space 35 in FIGS. 2A and 2B.

The lifting/lowering body 32 and the lifting/lowering actuator have strength and driving force set such that the corrugated roll units 10 are respectively accommodated in the accommodation support spaces 35 and 36 and can be lifted and lowered in a state of being supported by the support arms 33 and 34.

In addition, the lifting/lowering device 30 supports the corrugated roll unit 10 with the support arms 33 and 34 of the lifting/lowering body 32 only when the corrugated roll unit 10 is lifted and lowered and supports the corrugated roll unit 10 by means of a support mechanism 37M having a movable support member 37 provided so as to correspond to the use position Pu after the corrugated roll unit 10 is moved to the use position Pu.

Figure 3:
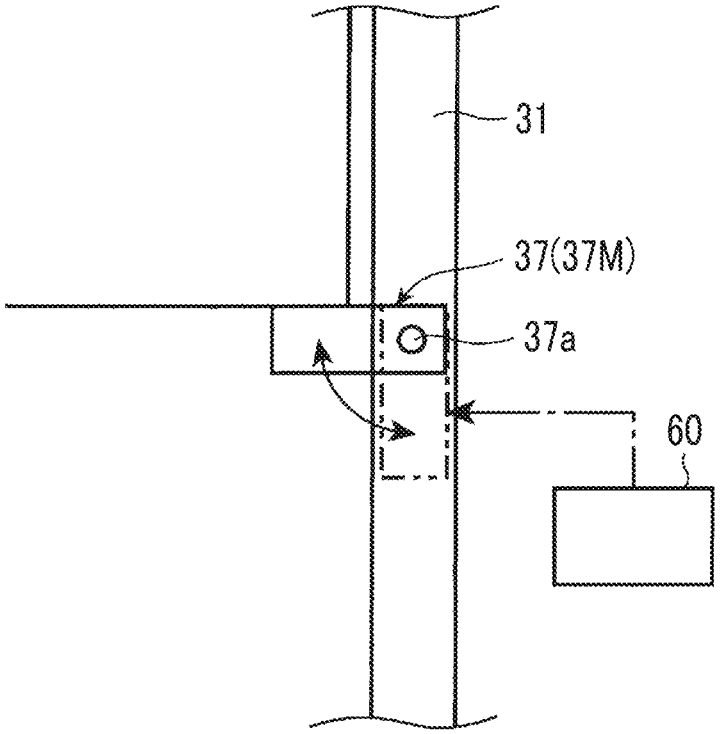
FIG. 3 is a diagram illustrating a support mechanism of the single facer according to one embodiment of the present invention.

As illustrated in FIG. 3, the movable support member 37 is swingably supported by the column 31 by means of a pin 37*a* and is driven by a turning actuator (not illustrated) included in the support mechanism 37M between a retracted position indicated by a two-dot chain line and a support position indicated by a solid line. The movable support member 37 is mechanically regulated in terms of swinging by a stopper (not illustrated) at at least the support position and is capable of supporting the corrugated roll unit 10 at the use position Pu from below without relying on the reaction force of the turning actuator.

Figure 4:
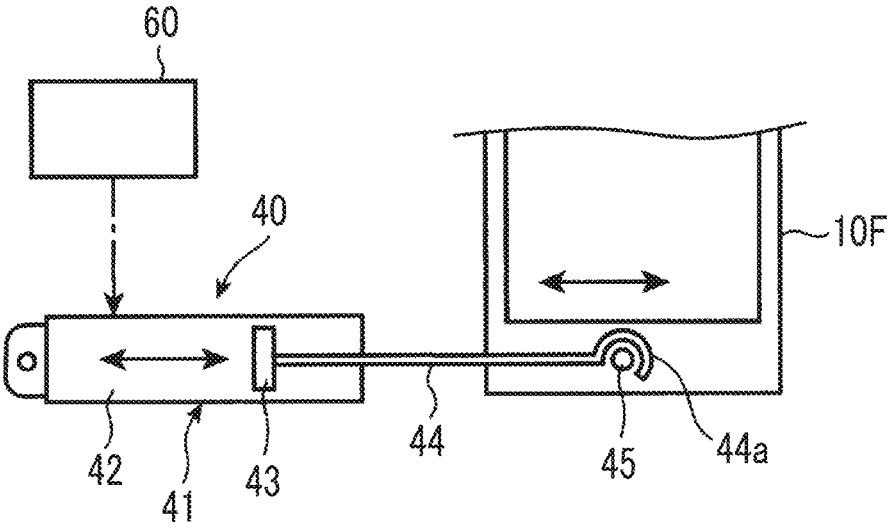
FIG. 4 is a diagram illustrating a horizontal movement device of the single facer according to one embodiment of the present invention.

The horizontal movement device 40 includes a hydraulic cylinder device 41 as an actuator as illustrated in FIG. 4. The hydraulic cylinder device 41 is arranged in the horizontal direction, and a piston rod 44 connected to a piston 43 reciprocating in a cylinder 42 moves in the horizontal direction in accordance with hydraulic pressure. A hook-shaped locking portion 44*a* is formed at the tip of the piston rod 44, and the corrugated roll unit 10 is moved in the horizontal direction in accordance with the expansion and contraction of the hydraulic cylinder device 41 by the locking portion 44*a* being locked to a pin 45 protruding from the lower side surface of the frame 10F of the corrugated roll unit 10.

It should be noted that the locking portion 44*a* can be engaged with and disengaged from the pin 45 and the locking portion 44*a* is locked to the pin 45 in a case where the corrugated roll unit 10 is moved in the horizontal direction.

In addition, the horizontal movement device 40 is capable of horizontally moving the corrugated roll unit 10 between the first position P1 and the third position P3 and horizontally moving the corrugated roll unit 10 between the first position P1 and the fourth position P4. It is also possible to horizontally move two corrugated roll units 10 at the same time by means of a cooperation mechanism (not illustrated). In addition, a horizontal movement device horizontally moving the corrugated roll unit 10 between the first position P1 and the third position P3 and a horizontal movement device horizontally moving the corrugated roll unit 10 between the first position P1 and the fourth position P4 may be respectively provided as the horizontal movement device 40.

In addition, as illustrated in FIG. 1, a bogie 50 as a width direction movable mechanism is provided at each of the third position P3 and the fourth position P4. The bogie 50 includes a bogie main body 51 and wheels 52 rotatably and pivotally supported by the bogie main body 51 and can be moved in a device width direction orthogonal to the sheet transfer direction in a state where the corrugated roll unit 10 is placed on the bogie main body 51. It should be noted that the bogie 50 may be provided at only one of the third position P3 and the fourth position P4 and the other may be an immovable fixed base.

It should be noted that the horizontal movement by the horizontal movement device 40 can be smoothly performed by a caster (not illustrated) being provided below the frame 10F of each corrugated roll unit 10. It should be noted that the corrugated roll unit 10 travels on the bogie main body 51 or the fixed base at the third position P3 and the fourth position P4 and the corrugated roll unit 10 travels on a support plate portion (not illustrated), which is provided at a height position near each of the support arms 33 and 34 of the lifting/lowering body 32, at the first position P1 during the horizontal movement.

The respective actuators of the lifting/lowering device 30, the movable support member 37, and the horizontal movement device 40 are controlled by a control device 60, and the corrugated roll unit 10 that is required can be moved and switched in terms of disposition as a result.

[Control Device]

Here, the control by the control device 60 will be described.

It should be noted that the third position P3 and the fourth position P4 here are standby positions where a standby corrugated roll unit 10W, which is provided in the device of the single facer without being used for corrugation, is positioned and exchange for the corrugated roll unit 10 that is in use for corrugation is performed in accordance with a production order.

In a case where the corrugated roll unit 10 in use is exchanged for the standby corrugated roll unit 10W in accordance with a production order and corrugation condition switching is performed, the control device 60 performs this switching by controlling each actuator.

The spaces of the first position P1 and the second position P2 where the corrugated roll unit 10 is not positioned are used for this switching between the corrugated roll units 10. It should be noted that the first position P1 and the second position P2 are exchange positions used when the corrugated roll unit 10 is exchanged.

FIGS. 5A to 5F illustrate a specific example of the exchange of the corrugated roll unit 10 by the control device 60. It should be noted that the three corrugated roll units 10, 10W, and 10W provided in the device will be distinguished by symbols A, B, and C being attached in the following description.

In this example, exchange is performed such that the standby corrugated roll unit B at the third position P3 is used instead of the corrugated roll unit A in use at the use position Pu.

Figure 5A:
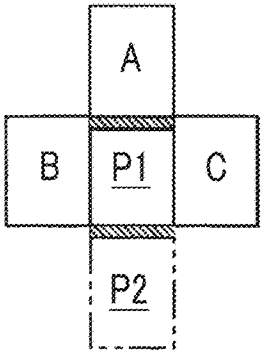
FIGS. 5A to 5F are a diagram illustrating steps of exchanging the corrugated roll unit of the single facer according to one embodiment of the present invention in the order of FIGS. 5A to 5F.

First, the corrugated roll unit A in use is positioned at the use position Pu, the standby corrugated roll unit B is positioned at the third position P3, and the standby corrugated roll unit C is positioned at the fourth position P4 as illustrated in FIG. 5A. The first position P1 and the second position P2 are empty.

Figure 5B:
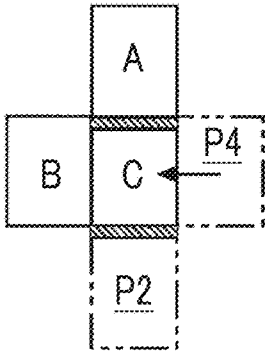

First, after the single facer is stopped, the hydraulic cylinder device 41 of the horizontal movement device 40 is operated and the corrugated roll unit C is horizontally moved from the fourth position P4 to the first position P1 as illustrated in FIG. 5B.

Figure 5C:
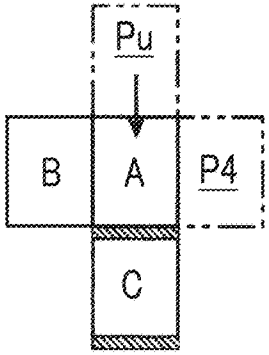

Next, the actuator of the movable support member 37 is operated, the movable support member 37 is swung from the support position to the retracted position, and then the corrugated roll unit A is lowered from the use position Pu to the first position P1 and the corrugated roll unit C is lowered from the first position P1 to the second position P2 at the same time, as illustrated in FIG. 5C, by the actuator of the lifting/lowering device 30 being operated.

Figure 5D:
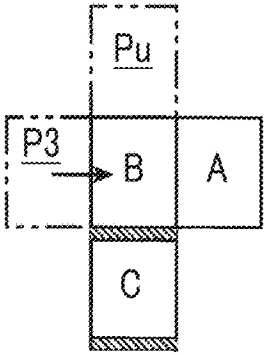

Next, the corrugated roll unit B is horizontally moved from the third position P3 to the first position P1 and the corrugated roll unit A is horizontally moved from the first position P1 to the fourth position P4 at the same time, as illustrated in FIG. 5D, by the hydraulic cylinder device 41 of the horizontal movement device 40 being operated.

Figure 5E:
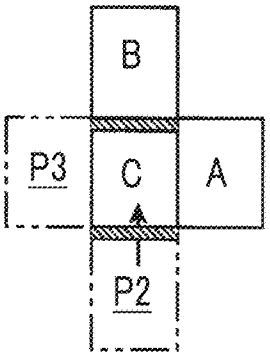

Next, the corrugated roll unit B is lifted from the first position P1 to the use position Pu and the corrugated roll unit C is lifted from the second position P2 to the first position P1 at the same time, as illustrated in FIG. 5E, by the actuator of the lifting/lowering device 30 being operated.

Figure 5F:
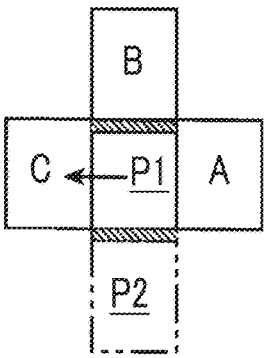

Lastly, the corrugated roll unit C is horizontally moved from the first position P1 to the third position P3 as illustrated in FIG. 5F by the hydraulic cylinder device 41, which is the actuator of the horizontal movement device 40, being operated.

In addition, the movable support member 37 is swung from the retracted position to the support position by the actuator of the movable support member 37 being operated.

[Method for Switching Corrugated Roll Unit of Single Facer]

The switching procedure for the corrugated roll unit 10 in use performed by the control of the control device 60 is further generalized as follows as a method for switching the corrugated roll unit of the single facer.

As a premise, exchange is performed between the corrugated roll unit A, which is the corrugated roll unit 10 in use, and the corrugated roll unit B, which is one of the standby corrugated roll unit B and the standby corrugated roll unit C, in accordance with a change in production order and the corrugated roll unit 10 that is used is switched (see FIG. 5A). The single facer is stopped and the following processing is performed.

First, as a first step, the horizontal movement device 40 is operated and the corrugated roll unit C, which is the remaining standby corrugated roll unit, is horizontally moved to the first position P1 from the fourth position P4, which is one of the third position P3 and the fourth position P4 as the two standby positions (see FIG. 5B).

Next, as a second step, the lifting/lowering device 30 is operated and the corrugated roll unit A at the use position Pu is lowered to the first position P1 and the corrugated roll unit C at the first position P1 is lowered to the second position P2 (see FIG. 5C).

Next, as a third step, the horizontal movement device 40 is operated and the corrugated roll unit B at the third position P3, which is the other of the third position P3 and the fourth position P4 as the two standby positions, is horizontally moved to the first position P1 and the corrugated roll unit A at the first position P1 is horizontally moved to the fourth position P4 (see FIG. 5D).

Next, as a fourth step, the lifting/lowering device 30 is operated and the corrugated roll unit B at the first position P1 is lifted to the use position Pu and the corrugated roll unit C at the second position P2 is lifted to the first position P1 (see FIG. 5E).

Further, as a fifth step, the horizontal movement device 40 is operated and the corrugated roll unit C at the first position P1 is horizontally moved to the third position P3 (see FIG. 5F).

In addition, the movable support member 37 is swung from the retracted position to the support position by the actuator of the movable support member 37 being operated until before the starting of the single facer.

[Method for Exchanging Standby Corrugated Roll Unit of Single Facer]

It should be noted that the standby corrugated roll unit 10W in the present single facer can be exchanged even during the operation of the single facer.

In other words, the standby corrugated roll unit 10W at either the third position P3 or the fourth position P4, which is a standby position, is carried out by being moved in the carrying-out direction of the device width direction by means of the bogie 50 as the width direction movable mechanism (carrying-out step).

Then, another corrugated roll unit newly put on standby at the third position P3 or the fourth position P4 emptied by the corrugated roll unit 10W being carried out is carried in by being moved in the carrying-in direction of the device width direction by means of the bogie 50 (carrying-in step).

It should be noted that the drive side or the operation side of the single facer can be used as a temporary standby place during the exchange of the standby corrugated roll unit 10W.

[Actions and Effects]

The single facer, the method for switching the corrugated roll unit of the single facer, and the method for exchanging the corrugated roll unit of the single facer according to the present embodiment are configured as described above, and thus the following actions and effects can be obtained.

In other words, since the four positions of the first position P1 to the fourth position P4 as well as the use position Pu are provided as positions where the corrugated roll unit 10 can be disposed and each of the use position Pu and the second position P2 to the fourth position P4 is disposed adjacent to and about the first position P1, each corrugated roll unit 10 can be moved to any position by means of the first position P1 even when three corrugated roll units 10 are provided in the device and the three corrugated roll units 10 can be selectively used in accordance with a production order.

Accordingly, when three types of corrugated roll units 10 having different flute shapes are provided in the device, it is possible to respond to a production order of the three types of flute shapes without performing exchange by introducing the corrugated roll unit 10 for exchange from the outside. As a result, the corrugated roll unit 10 can be quickly switched and productivity is improved.

In addition, the corrugated roll unit 10 that is required can be moved and automatically switched in terms of disposition by the control device 60 controlling the respective actuators of the lifting/lowering device 30, the movable support member 37, and the horizontal movement device 40, and thus it is possible to reduce a worker's burden at the time of a production-related order change.

In addition, each of the first position P1 to the fourth position P4 can be disposed within the device width, and thus it is possible to suppress an increase in device size.

In the present embodiment, the third position P3 and the fourth position P4 on the floor surface F of the factory are standby positions, and thus it is possible to exchange the standby corrugated roll unit 10W without hindering the corrugated roll unit 10 in use even during the operation of the single facer. As a result, it is possible to use more than three (types of) corrugated roll units 10 without increasing the stop time of the single facer.

Alternatively, the first position P1 or the second position P2 may be a standby position.

In this case, it is possible to exchange the standby corrugated roll unit 10W by, for example, supporting the standby corrugated roll unit 10W at the second position P2 with the bogie 50 as the width direction movable mechanism and using the lower side of the floor surface F on the drive side or the operation side of the single facer, which is the outer side of the second position P2 in the width direction, that is, the underground, as a temporary standby place.

In addition, since the corrugated roll unit 10 at the use position Pu is supported by the movable support member 37, the load burden of the lifting/lowering device 30 can be reduced and the durability of the device can be improved. Alternatively, the movable support member 37 may be eliminated and the corrugated roll unit 10 at the use position Pu may be supported by the lifting/lowering device 30 when there is no problem in relation to the load burden of the lifting/lowering device 30.

In addition, in the present embodiment, the lifting/lowering device 30 is lifted and lowered in a state where the corrugated roll units 10 are respectively accommodated in the accommodation support spaces 35 and 36 supported by the support arms 33 and 34, and thus only one stage of lifting/lowering stroke will suffice and an increase in the size of the lifting/lowering device 30 in the up-down direction can be suppressed. Alternatively, the lifting/lowering device 30 may have two stages of lifting/lowering stroke and the corrugated roll units 10 may be lifted and lowered one by one. In this case, the load burden related to the lifting and lowering of the lifting/lowering device 30 is reduced although the size of the lifting/lowering device 30 in the up-down direction increases.

[Other]

Although an embodiment of the present invention has been described above, the present invention is not limited to the above-described embodiment and various modifications can be made without departing from the spirit of the present invention.

For example, although the control device 60 automatically controls the operation of each of the actuators of the lifting/lowering device 30, the movable support member 37, and the horizontal movement device 40 in the above-described embodiment, a worker may control the operation of each actuator by switch operation or the like.

In addition, although the description of the above-described embodiment assumes a worker exchanging the standby corrugated roll unit 10W, the exchange of the standby corrugated roll unit 10W may also be automatically performed by the control device 60 or another control device.

In addition, although exchange is performed such that the standby corrugated roll unit B at the third position P3 is used instead of the corrugated roll unit A in use at the use position Pu in the above-described embodiment, exchange may performed such that the standby corrugated roll unit C at the fourth position P4 is used.

In addition, although the single facer is equipped with the bogie 50 as the width direction movable mechanism allowing the corrugated roll unit to move in the device width direction in the above-described embodiment, a width direction movement device may be provided that actively moves at least the corrugated roll unit at the standby position in the device width direction.

REFERENCE SIGNS LIST

1 Medium
2 Liner
3 Single-faced cardboard
10 Corrugated roll unit
10F Frame
11 Upper corrugating roll
12 Lower corrugating roll
20 Adhesive equipment
30 Lifting/lowering device
31 Column
32 Lifting/lowering body
33, 34 Support arm

35, 36 Accommodation support space
37 Movable support member
37M Support mechanism
40 Horizontal movement device
41 Hydraulic cylinder device as actuator
44 Piston rod
44*a* Locking portion
45 Pin
50 Bogie as width direction movable mechanism
51 Bogie main body
52 Wheel
60 Control device
F Floor surface
Pu Use position
P1 First position
P2 Second position
P3 Third position
P4 Fourth position

The invention claimed is:

1. A single facer equipped with a plurality of corrugated roll units each composed of a pair of corrugated rolls, the single facer comprising:

a lifting/lowering device causing each of the corrugated roll units to be lifted and lowered between a use position at which a medium is to be corrugated, a first position adjacent to and directly under the use position, and a second position adjacent to and directly under the first position;

a horizontal movement device causing each of the corrugated roll units to be moved horizontally between the first position, a third position adjacent to the first position on one side in a sheet transfer direction, and a fourth position adjacent to the first position on the other side in the sheet transfer direction; and a control device controlling the lifting/lowering device and the horizontal movement device to move the corrugated roll units.

2. The single facer according to claim 1, wherein three corrugated roll units having different flutes are provided as the plurality of corrugated roll units, and the control device disposes any one of the three corrugated roll units suitable for a production order at the use position and disposes the remaining two corrugated roll units at standby positions which are any two of the first to fourth positions.

3. The single facer according to claim 2, wherein the first position and the second position are exchange positions used when the corrugated roll units are exchanged and the third position and the fourth position are the standby positions, and the control device uses the first position and the second position in performing exchange between the corrugated roll unit disposed at the use position and the corrugated roll unit disposed at the third position or the fourth position in accordance with a change in production order.

4. The single facer according to claim 3, wherein the lifting/lowering device includes two stages of accommodation support spaces accommodating and supporting the corrugated roll units to be lifted and lowered, one above the other, and is configured to be lifted and lowered in a state where the corrugated roll units are accommodated and supported in the respective accommodation support spaces.

5. The single facer according to claim 4, wherein when exchange is performed between the corrugated roll unit disposed at the use position and the corrugated roll unit disposed at the third position in accordance with a change in production order, the control device, horizontally moves the corrugated roll unit disposed at the fourth position to the first position by operating the horizontal movement device, lowers the corrugated roll unit at the use position to the first position and lowers the corrugated roll unit at the first position to the second position by operating the lifting/lowering device, horizontally moves the corrugated roll unit at the third position to the first position and horizontally moves the corrugated roll unit at the first position to the fourth position by operating the horizontal movement device, lifts the corrugated roll unit at the first position to the use position and lifts the corrugated roll unit at the second position to the first position by operating the lifting/lowering device, and horizontally moves the corrugated roll unit at the first position to the third position by operating the horizontal movement device.

6. The single facer according to claim 1, further comprising a support mechanism having a movable support member capable of switching between a retracted position not interfering with the corrugated roll unit when the corrugated roll unit is lifted and lowered to the use position and a support position supporting the corrugated roll unit at the use position, wherein the control device performs control to switch a position of the movable support member between the retracted position and the support position.

7. The single facer according to claim 2, further comprising a width direction movable mechanism allowing the corrugated roll unit at at least one of the two standby positions to move in a device width direction orthogonal to the sheet transfer direction.

8. The single facer according to claim 7, further comprising a width direction movement device moving the corrugated roll unit at the one standby position in the device width direction.

9. A method for switching a corrugated roll unit of a single facer, the method being for switching the corrugated roll unit to be used by performing exchange between the corrugated roll unit disposed at the use position and the corrugated roll unit disposed at the third position in accordance with a change in production order in the single facer according to claim 3, the method comprising:

a step of horizontally moving the corrugated roll unit disposed at the fourth position to the first position by operating the horizontal movement device;

a step of lowering the corrugated roll unit at the use position to the first position and lowering the corrugated roll unit at the first position to the second position by operating the lifting/lowering device;

a step of horizontally moving the corrugated roll unit at the third position to the first position and horizontally moving the corrugated roll unit at the first position to the fourth position by operating the horizontal movement device;

a step of lifting the corrugated roll unit at the first position to the use position and lifting the corrugated roll unit at the second position to the first position by operating the lifting/lowering device; and a step of horizontally moving the corrugated roll unit at the first position to the third position by operating the horizontal movement device.

10. A method for exchanging a corrugated roll unit of a single facer, the method being for exchanging the corrugated roll unit at the standby position in the single facer according to claim 7, the method comprising:

a carrying-out step of moving the corrugated roll unit at the one standby position in a carrying-out direction of the device width direction and carrying out the corrugated roll unit; and a carrying-in step of moving a corrugated roll unit different from the carried-out corrugated roll unit in a carrying-in direction of the device width direction and carrying in the different corrugated roll unit.

* * * * *